US006992679B2

(12) United States Patent
Tillery, Jr. et al.

(10) Patent No.: US 6,992,679 B2
(45) Date of Patent: Jan. 31, 2006

(54) HARDWARE DISPLAY ROTATION

(75) Inventors: Donald Richard Tillery, Jr., Frisco, TX (US); Franck Seigneret, Roquefort les pins (FR); Jean Noel, Nice (FR); Jeffrey Taylor, Lucas, TX (US)

(73) Assignee: Texas Instruments Incorporated, Dallas, TX (US)

( * ) Notice: Subject to any disclaimer, the term of this patent is extended or adjusted under 35 U.S.C. 154(b) by 25 days.

(21) Appl. No.: 10/744,534

(22) Filed: Dec. 22, 2003

(65) Prior Publication Data

US 2005/0134597 A1 Jun. 23, 2005

(51) Int. Cl.
*G06F 12/10* (2006.01)

(52) U.S. Cl. ..... 345/568; 345/533

(58) Field of Classification Search ..... 345/503, 345/531, 533, 545, 564, 568–571, 649, 656, 345/658, 659; 382/276, 293, 295–297
See application file for complete search history.

(56) References Cited

U.S. PATENT DOCUMENTS 5,815,168 A * 9/1998 May ..... 345/572
5,956,049 A * 9/1999 Cheng ..... 345/568
5,990,912 A * 11/1999 Swanson ..... 345/568
6,064,407 A * 5/2000 Rogers ..... 345/568
6,215,507 B1 * 4/2001 Nally et al. ..... 345/568
6,608,626 B2 * 8/2003 Chan ..... 345/572
6,628,294 B1 * 9/2003 Sadowsky et al. ..... 345/568
6,639,603 B1 * 10/2003 Ishii ..... 345/568
6,667,745 B1 * 12/2003 Hussain ..... 345/545
6,760,035 B2 * 7/2004 Tjandrasuwita ..... 345/545
6,809,737 B1 * 10/2004 Lee et al. ..... 345/533
6,847,385 B1 * 1/2005 Garritsen ..... 345/672
2003/0122837 A1 * 7/2003 Saxena et al. ..... 345/566
2004/0239690 A1 * 12/2004 Wyatt et al. ..... 345/649

* cited by examiner

*Primary Examiner*—Kee M. Tung
(74) *Attorney, Agent, or Firm*—J. Dennis Moore; W. James Brady, III; Frederick J. Telecky, Jr.

(57) ABSTRACT

A visual display is provided on a data processing apparatus by storing and retrieving display information. The display information is stored by receiving write access addresses (33), translating the write access addresses into write memory addresses (15) and using the write memory addresses to store the display information (11). The read operation includes providing read access addresses (37), translating the read access addresses into memory read addresses (19) and using the memory read addresses to retrieve the display information (11).

18 Claims, 8 Drawing Sheets

| | | | | | | | | | | | | | | | | | | | | | | | | |
|---|---|---|---|---|---|---|---|---|---|---|---|---|---|---|---|---|---|---|---|---|---|---|---|---|
| 0000 | 0001 | 0002 | 0003 | 0004 | 0005 | 0006 | 0007 | 0008 | 0009 | 0010 | 0011 | 0012 | 0013 | 0014 | 0015 | 0016 | 0017 | 0018 | 0019 | 0020 | 0021 | 0022 | 0023 | . . . |

*FIG. 2*
*(PRIOR ART)*

| | | | | | | | | | | | | | | | |
|---|---|---|---|---|---|---|---|---|---|---|---|---|---|---|---|
| 0000 | 0001 | 0002 | 0003 | 0004 | 0005 | 0006 | 0007 | 0008 | 0009 | 0010 | 0011 | 0012 | 0013 | 0014 | 0015 |
| 0016 | 0017 | 0018 | 0019 | 0020 | 0021 | 0022 | 0023 | 0024 | 0025 | 0026 | 0027 | 0028 | 0029 | 0030 | 0031 |
| 0032 | 0033 | 0034 | 0035 | 0036 | 0037 | 0038 | 0039 | 0040 | 0041 | 0042 | 0043 | 0044 | 0045 | 0046 | 0047 |
| 0048 | | | | | | | | | | | | | | | . . . |
| 0064 | | | | | | | | | | | | | | | |
| 0080 | | | | | | | | | | | | | | | |
| 0096 | | | | | | | | | | | | | | | |
| 0112 | | | | | | | | | | | | | | | |
| 0128 | | | | | | | | | | | | | | | |
| 0144 | | | | | | | | | | | | | | | |
| 0160 | | | | | | | | | | | | | | | |
| 0176 | | | | | | | | | | | | | | | |
| 0192 | | | | | | | | | | | | | | | |
| 0208 | | | | | | | | | | | | | | | |
| 0224 | | | | | | | | | | | | | | | |
| . . . | | | | | | | | | | | | | | | |

*FIG. 3*
*(PRIOR ART)*

| | | | | | | | | | | | | | | | |
|---|---|---|---|---|---|---|---|---|---|---|---|---|---|---|---|
| 0000 | 0001 | 0002 | 0003 | 0004 | 0005 | 0006 | 0007 | 0008 | 0009 | 0010 | 0011 | 0012 | 0013 | 0014 | 0015 |
| 0016 | 0017 | 0018 | 0019 | 0020 | 0021 | 0022 | 0023 | 0024 | 0025 | 0026 | 0027 | 0028 | 0029 | 0030 | 0031 |
| 0032 | 0033 | | | | | | | | | | | | | | ⋮ |
| 0048 | 0049 | | | | | | | | | | | | | | |
| 0064 | 0065 | | | | | | | | | | | | | | |
| 0080 | 0081 | | | | | | | | | | | | | | |
| 0096 | 0097 | | | | | | | | | | | | | | |
| 0112 | 0113 | | | | | | | | | | | | | | |
| 0128 | 0129 | | | | | | | | | | | | | | |
| 0144 | 0145 | | | | | | | | | | | | | | |
| 0160 | 0161 | | | | | | | | | | | | | | |
| 0176 | 0177 | | | | | | | | | | | | | | |
| 0192 | 0193 | | | | | | | | | | | | | | |
| 0208 | 0209 | | | | | | | | | | | | | | |
| 0224 | 0225 | | | | | | | | | | | | | | |
| 0240 | 0241 | | | | | | | | | | | | | | ⋮ |
| 0256 | 0257 | | | | | | | | | | | | | | |
| 0272 | 0273 | ⋯ | | | | | | | | | | | | ⋯ | 0287 |
| ⋮ | ⋮ | | | | | | | | | | | | | | ⋮ |

*FIG. 4*
*(PRIOR ART)*

| | | | | | | | | | | | | | | | |
|---|---|---|---|---|---|---|---|---|---|---|---|---|---|---|---|
| 0272 | 0256 | 0224 | 0208 | 0192 | 0176 | 0160 | 0144 | 0128 | 0112 | 0096 | 0064 | 0048 | 0032 | 0016 | 0000 |
| 0273 | 0257 | 0225 | 0209 | 0193 | 0177 | 0161 | 0145 | 0129 | 0113 | 0097 | 0065 | 0049 | 0033 | 0017 | 0001 |
| 0274 | 0258 | | | | | | | | | | | | | | |
| 0275 | 0259 | | | | | | | | | | | | | | |
| 0276 | 0260 | | | | | | | | | | | | | | |
| 0277 | 0261 | | | | | | | | | | | | | | |
| 0278 | 0262 | | | | | | | | | | | | | | |
| 0279 | 0263 | | | | | | | | | | | | | | |
| 0280 | 0264 | | | | | | | | | | | | | | |
| 0281 | 0265 | | | | | | | | | | | | | | |
| 0282 | 0266 | | | | | | | | | | | | | | |
| 0283 | 0267 | | | | | | | | | | | | | | |
| 0284 | 0268 | | | | | | | | | | | | | | |
| 0285 | 0269 | | | | | | | | | | | | | | |
| 0286 | 0270 | | | | | | | | | | | | | | |
| 0287 | 0271 | . . . | | | | | | | | | | . . . | | . . . | 0015 |

*FIG. 4A*
*(PRIOR ART)*

| | |
|---|---|
| 0000 | 0 |
| 0512 | 1 |
| 1024 | 2 |
| 1536 | 3 |
| 2048 | 4 |
| 2560 | 5 |
| 3072 | 6 |
| 3584 | 7 |
| ⋮ | ⋮ |

*FIG. 5*

| | | | |
|---|---|---|---|
| 0 | 3 | 6 | 9 |
| 1 | 4 | 7 | 10 |
| 2 | 5 | 8 | 11 |

*FIG. 6*

| | | |
|---|---|---|
| 2 | 1 | 0 |
| 5 | 4 | 3 |
| 8 | 7 | 6 |
| 11 | 10 | 9 |

*FIG. 7*

*FIG. 8*

(0-Degree)
aperture offset= access address - aperture base address
lsbs= access address & ~ (display depth - 1)
memory offset= ((aperture offset / horizontal strip) * page size) +
(((aperture offset % display width) / tile width) * vertical strip) +
(((aperture offset / display width) % tile height) * tile width) +
(aperture offset % tile width)
memory address= memory base address + (memory offset | lsbs)

```
90-Degree
aperture offset= access address - aperture base address
lsbs= access address & ~ (display depth - 1)
memory offset= (aperture offset - (aperture offset % vertical strip)) +
               ((tile rows - (((aperture offset / display depth) % display height) / tile height) - 1) * page size) +
               ((tile height - ((aperture offset / display depth) % tile height) - 1) * tile width) +
               (((aperture offset / (display height * display depth)) % (tile width / display depth)) * display depth)
memory address= memory base address + (memory offset | lsbs)
```

*FIG. 9*

```
180-Degree
aperture offset= access address - aperture base address
lsbs= access address & ~ (display depth - 1)
memory offset= ((tile rows - (aperture offset / horizontal strip) - 1) * page size) +
               ((tile columns - ((aperture offset % display width) / tile width) - 1) * vertical strip) +
               ((tile height - ((aperture offset / display width) % tile height) - 1) * tile width) +
               (tile width - (aperture offset % tile width) - display depth)
memory address= memory base address + (memory offset | lsbs)
```

*FIG. 10*

```
270-Degree
aperture offset= access address - aperture base address
lsbs= access address & ~ (display depth - 1)
memory offset= ((tile columns - (aperture offset / vertical strip) - 1) * vertical strip) +
               ((((aperture offset / display depth) % display height) / tile height) * page size) +
               (((aperture offset / display depth) % tile height) * tile width) +
               ((tile width / display depth) - ((aperture offset / (display height * display depth)) % (tile width / display depth)) - 1) * display depth
memory address= memory base address + (memory offset | lsbs)
```

*FIG. 11*

*FIG. 12*

(0-Degree)
shift0= horizontal strip power - page size power
minuend0= 0
mask0= ((display size - 1) / horizontal strip) * page size
shift1= tile width power - vertical strip power
minuend1= 0
mask1= (((display size - 1) % display width) / tile width) * vertical strip
shift2= display width power - tile width power
minuend2= 0
mask2= (((display size - 1) / display width) % tile height) * tile width
shift3= 0
minuend3= 0
mask3= (display size - 1) % tile width

*FIG. 14*

180-Degree
shift0= horizontal strip power - page size power
minuend0= (tile rows - 1) * page size
mask0= ((display size - 1) / horizontal strip) * page size
shift1= tile width power - vertical strip power
minuend1= (tile columns - 1) * vertical strip
mask1= (((display size - 1) % display width) / tile width) * vertical strip
shift2= display width power - tile width power
minuend2= (tile height - 1) * tile width
mask2= (((display size - 1) / display width) % tile height) * tile width
shift3= 0
minuend3= tile width - 1
mask3= (display size - display depth) % tile width

*FIG. 13*

90-Degree
shift0= 0
minuend0= 0
mask0= ((display size - 1) / vertical strip) * vertical strip
shift1= tile height power + display depth power - page size power
minuend1= (tile rows - 1) * page size
mask1= ((((display size - 1) / display depth) % display height) / tile height) * page size
shift2= display depth power - tile width power
minuend2= (tile height - 1) * tile width
mask2= (((display size - 1) / display depth) % tile height) * tile width
shift3= display height power
minuend3= 0
mask3= (((display size - 1) / (display height * display depth)) % (tile width / display depth)) * display depth

*FIG. 15*

270-Degree
shift0= 0
minuend0= (tile columns - 1) * vertical strip
mask0= ((display size - 1) / vertical strip) * vertical strip
shift1= tile height power + display depth power - page size power
minuend1= 0
mask1= ((((display size - 1) / display depth) % display height) / tile height) * page size
shift2= display depth power - tile width power
minuend2= 0
mask2= (((display size - 1) / display depth) % tile height) * tile width
shift3= display height power
minuend3= ((tile width / display depth) - 1) * display depth
mask3= (((display size - 1) / (display height * display depth)) % (tile width / display depth)) * display depth

HARDWARE DISPLAY ROTATION

FIELD OF THE INVENTION

The invention relates generally to data processing and, more particularly, to processing data for visual display.

BACKGROUND OF THE INVENTION

Almost all desktop systems employ a landscape orientation of their displays. This is characterized by a display that is wider than it is tall. Video monitors and televisions also utilize landscape orientations. However, handheld device orientations vary based on the desired form factors of the products themselves. Often, the device uses a portrait orientation instead, which is characterized by a display that is taller than it is wide.

Due to the prevalence of systems that employ landscape orientations, there is a corresponding prevalence of displays that are designed for landscape orientations. Eventually, as there is more demand for portrait oriented images, portrait oriented displays will become available. But portrait displays are currently more expensive than their landscape counterparts.

It should be noted that in the long run, it is in the best interest of the product developers to eventually migrate to a natively portrait display for use with portrait oriented images. This will provide the maximum power efficiency and highest performance for the display. However, the lack of availability and/or higher cost of natively portrait displays can outweigh the power and performance advantages. Moreover, even when natively portrait displays do become available, there will be devices which need to switch between landscape and portrait orientations.

The invention provides a hardware solution that rotates a landscape oriented image to a portrait orientation for display on a landscape display, and vice-versa.

BRIEF DESCRIPTION OF THE DRAWINGS

FIG. 2 conceptually illustrates conventional flat memory organization.

FIG. 3 conceptually illustrates conventional rectangular memory organization.

FIG. 4 conceptually illustrates a conventional example of a rectangular memory organization.

FIG. 4A conceptually illustrates a conventional 90° rotation of the rectangular memory organization of FIG. 4.

FIG. 5 conceptually illustrates a conventional memory page arrangement.

FIG. 6 conceptually illustrates a tiled arrangement of the memory pages of FIG. 5 according to the invention.

FIG. 7 conceptually illustrates a rotated version of the tiled memory page arrangement of FIG. 6 according to the invention.

FIG. 8 illustrates address translation equations which can be implemented by exemplary embodiments of the invention to translate from the memory page arrangement of FIG. 5 to the tiled memory page arrangement of FIG. 6.

FIGS. 9–11 illustrate address translation equations which can be implemented by exemplary embodiments of the invention to translate the memory page arrangement of FIG. 5 into a rotated version of the tiled memory page arrangement of FIG. 6, such as the rotated version illustrated in FIG. 7.

FIGS. 12–15 illustrate equations which specify parameter values that can be utilized by exemplary embodiments of the invention to implement the address translation equations of FIGS. 8–11.

DETAILED DESCRIPTION

Figure 1:
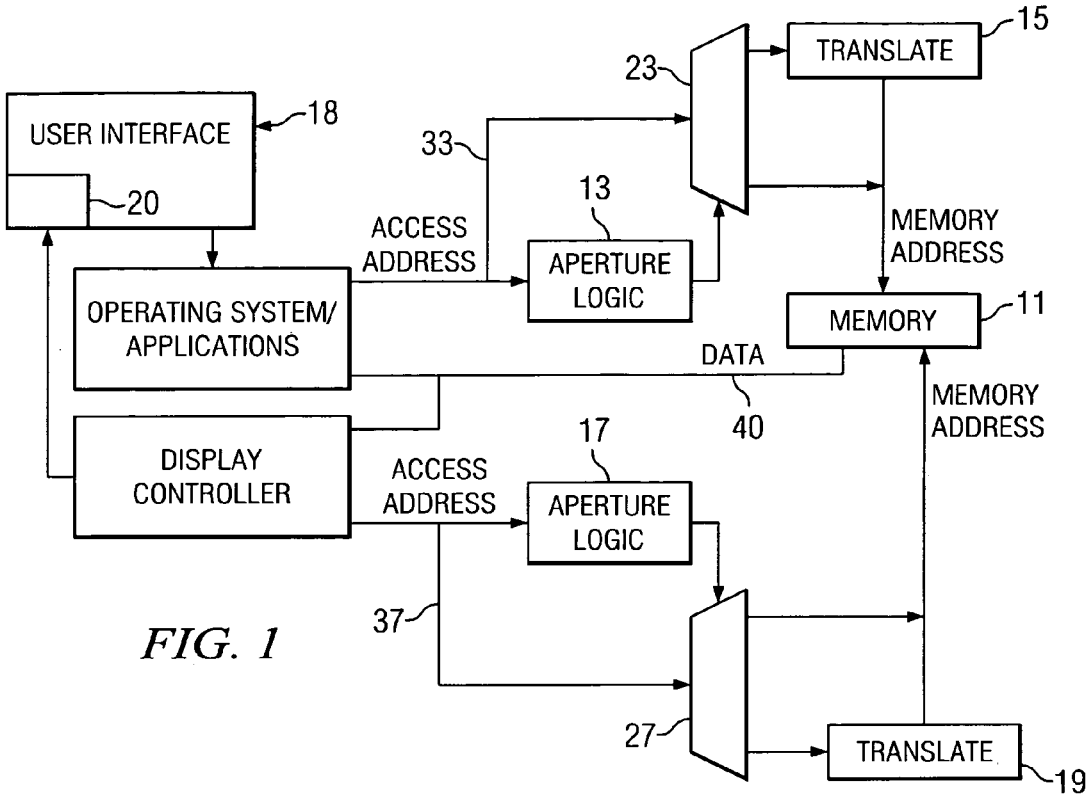
FIG. 1 diagrammatically illustrates exemplary embodiments of a data processing apparatus according to the invention.

Display systems typically consist of a section of memory that is dedicated for graphics. Data from this section of memory is repeatedly rastered out to the display as it is refreshed. Applications and the operating system draw their graphics into this region of memory so that it shows up on the display. Normally, the operating system and applications assume that this memory is organized the same way as that memory on desktop systems. This orientation turns the one-dimensional memory (FIG. 2) into a two-dimensional framebuffer (FIG. 3) by conceptualizing the memory as being broken into lines of a specified width, creating a rectangular organization of the memory. The operating system or application uses the rectangular information to render two-dimensional images into the graphics memory.

Since memory was designed to be read sequentially for greatest efficiency, the normal method of refreshing the display also proceeds sequentially, in order to take advantage of this design. If the orientation of this memory matches the orientation of the display, which would be the case for the normal orientations outlined above, then both the software and hardware are working at the most efficient level possible, and there is no need for any rotation.

However, when the software and display must view the memory differently, there must be some rotation to provide each part with its desired orientation (see FIGS. 4 and 4A). This can be approached via software or hardware. One method of handling rotation of the display using hardware is to modify the display access to the framebuffer and have the memory accesses for the display subsystem read the data in the rotated format shown in the 90-degree view of FIG. 4A. In this case, the operating system and applications access the framebuffer as shown in the non-rotated view in FIG. 4. One problem with this method is that the accesses to the framebuffer for display refresh are non sequential and become effectively random accesses to the memory. These accesses fail to take advantage of the sequential nature of the memory (bursting, pixel-packing, etc.). The overhead of display refreshing therefore increases significantly. Such a design would require substantially more power, severely limit system performance by monopolizing memory bandwidth, and put strict limitations on the resolutions that could be supported.

In a second hardware approach, the display subsystem accesses memory as seen in the non-rotated view of FIG. 4, while the operating system (OS) and applications see the rotated view. This is accomplished by intercepting the memory accesses and providing an address translation to the actual memory access. The software is provided with a "virtual" window into the framebuffer, also referred to herein as an aperture. Whenever the software accesses this aperture, the access address is translated to a corresponding actual address in the framebuffer. In most cases, this method results in better efficiency than the modified display access method above, because OS and applications generally do not access the framebuffer as often as the display. However, graphics performance is degraded for the same reasons given above, because the non-sequential accesses to the framebuffer cause each access to have a high overhead.

If the underlying graphics code can be modified or replaced, the rotation of the display can be accomplished via software. Many operations will suffer no appreciable performance degradation, because only the coordinates of the desired operation are rotated, and the operation proceeds in almost the same manner as its non-rotated counterpart. Nevertheless, there will be many operations that are impacted, because almost all external data (fonts, bitmaps, video, etc.) will need to be explicitly rotated. Unfortunately, in most systems, this level of access to underlying graphics code is either not possible or extremely impractical. For example, one conventional library of graphics functions performs over 128,000 different graphics operations, and replacing it for purposes of rotation would require several man-years of effort in development, debugging, and testing. Also, applications which run on top of such a library routinely make certain assumptions about the orientation of the memory with respect to the display, and unless every application can also be modified to add rotation support, they will not be compatible with this modified graphics code approach.

When the underlying graphics code cannot be modified or modifying it is impractical, the rotation of the display can often still be accomplished via software which operates outside of the baseline graphics code. In this scheme, an intermediate graphics buffer is allocated. This intermediate graphics buffer is oriented as needed by the operating system and applications. But the separate framebuffer that is actually displayed is oriented as necessary for the efficient feeding of data to the display. Then, once the software has completed a given graphics operation into the intermediate buffer (or at a specified interval) the data in this intermediate buffer (or better still, only the portion that was changed) is copied through a software rotation to the framebuffer. This approach is less efficient than the aforementioned graphics code modification, but it is more realistic in some cases where modifying the baseline operating system is impractical and where access to application source code is not possible.

The intermediate buffer approach can also be used with some hardware assistance. The data is copied and rotated to the framebuffer via a BLTer (Block Transfer engine) in place of software. This removes the software overhead of the rotation operation, but still leaves significant overhead.

In exemplary embodiments of the invention, the framebuffer itself is oriented neither for display nor for (OS or application) software, but instead in an intermediate, tiled format that is conducive to efficient software and display accesses simultaneously. Two separate apertures can be provided through which the display and software respectively access the framebuffer. These apertures provide the memory translation necessary to support the rotation.

The framebuffer is broken into tiles that consist of one memory page each. Example memory pages are shown at 0–7 in FIG. 5. Tiles are conceptually rectangular constructs (see FIGS. 6 and 7). Since the memory pages are always a power of two, the tiles' width and height in some embodiments are also powers of two. In some embodiments, the sequential display accesses map to the horizontal orientation of the framebuffer tiles, and the width of the tiles is generally at least the width of one burst, for maximum display efficiency. The tile-based design also allows successive accesses from the operating system or application to be from the same memory page.

Some embodiments provide apertures through which software will access the tiled framebuffer. One aperture represents a non-rotated access, as shown generally in FIG. 6. Some embodiments use this aperture for the display subsystem, and another aperture provides the operating system and applications with a rotated view of the same framebuffer, as shown generally in FIG. 7. For both apertures, the access address provided thereto will be translated appropriately before the actual memory access occurs.

The memory translation for a given aperture is accomplished via a four-part memory offset equation, examples of which are shown in FIGS. 8–11. One part accomplishes the translation of the access address to the tile's column. A second part translates the access address to the tile's row. The third part determines the proper line within the tile, and the fourth part specifies the byte within the line. Since the size of the display can vary, the baseline equations of FIGS. 8–11 are designed to allow for any display width, display height, page size, tile width and tile height. In these equations, all variables and intermediate values are integers. The percent symbol (%) indicates a modulo operator (the remainder after a division), and the symbol "|" designates a logical OR operation.

For 16-bit and 32-bit accesses, the least significant bits (one for 16-bit and two for 32-bit) are masked off before the equation (one of FIGS. 8–11) is applied, and are replaced after the translation is complete.

For the equations of FIGS. 8–11, the following are defined:

Page size—defined by memory architecture (bytes)

Display depth—defined by application (bytes)

Display width—defined by display hardware (pixels*display depth)

Display height—defined by display hardware (lines)

Tile width—normally the width of a burst (bytes)

Tile height=page size/tile width

Horizontal strip=display width*tile height

Vertical strip=display height*tile width

Tile rows=display height/tile height

Tile columns=display width/tile width

In order to implement the memory offset equations of FIGS. 8–11, it is desirable to reduce them to operations that can be accomplished within the address cycle of the bus. For example, division and multiplication operations can be replaced with shifts, and modulo operations can be replaced with masks when these operations are limited to powers of two. Replacement of subtraction and addition with logical OR and XOR operations can also be helpful. Therefore, some embodiments constrain the constant values to be powers of two. This is already true for the page size, so the tile width and height follow suit. The only real limit is placed on the display width and height, which is rounded up to the nearest power of two.

By performing the above simplifications, each part of each memory offset equation of FIGS. 8–11 can be converted into the following group of operations:

((aperture offset>>shift ^minuend) & mask

The shift operation (">>") is actually bi-directional, where a left shift is indicated by a negative value of the "shift" parameter. The "^" character represents an exclusive or (XOR) operation.

Using four of these groups of operations for each memory offset equation (see also FIGS. 8–11) creates the following general equation for the memory offset:

```
Memory offset =   (((aperture offset >> shift0) ^ minuend0) & mask0) |
                  (((aperture offset >> shift1) ^ minuend1) & mask1) |
                  (((aperture offset >> shift2) ^ minuend2) & mask2) |
                  (((aperture offset >> shift3) ^ minuend3) & mask3
```

When combined with all of the other portions of FIGS. 8–11 (and assuming that the aperture base address is a power-of-two so that the aperture offset is simply the least significant bits of the access address), the entire memory address equation for each aperture becomes

```
Memory address = memory base address +
    (((((aperture offset & depth mask) >> shift0) ^ minuend0) & mask0) |
    ((((aperture offset & depth mask) >> shift1) ^ minuend1) & mask1) |
    ((((aperture offset & depth mask) >> shift2) ^ minuend2) & mask2) |
    ((((aperture offset & depth mask) >> shift3) ^ minuend3) & mask3) |
    (aperture offset & ~ depth mask))
```

The "~" character represents a logical complement or not operation.

Such an equation will, in some embodiments, require approximately 10K gates. As mentioned above, at least two apertures are needed, one for the display subsystem, and one for software access.

The values of the programmable parameters in the memory offset and memory address equations shown above are derived from the equations for the different rotations (see FIGS. 8–11). The parameter values are specified in FIGS. 12–15. For the equations of FIGS. 12–15, the following are defined:

Tile width power=$\log_2$(Tile width)
Tile height power=$\log_2$(Tile height)
Page size power=$\log_2$(Page size)
Display width power=$\log_2$(Display width)
Display height power=$\log_2$(Display height)
Display depth power=$\log_2$(Display depth)
Horizontal strip power=$\log_2$(Horizontal strip)
Vertical strip power=$\log_2$(Vertical strip).

Display size=(Display width*Display height) is also defined for FIGS. 12–15.

Some embodiments implement the two address translations using two reserved regions of physical memory and two sets of 14 registers. The reserved regions of physical memory are the apertures through which the memory will be accessed. Whenever these regions of memory are accessed by the access address of FIGS. 8–11, the associated address translation occurs, and the memory access actually occurs to/from the physical memory location specified by the output of the address translation operation, namely the location specified by "memory address" as defined above.

In some embodiments, the apertures are of sufficient size to hold any conceivable resolution and color depth, are aligned on a power-of-two boundary, and are a power-of-two in size. An example high-end assumption would be a 2048×2048×32 bpp display. This requires apertures of 16 MB, which means that the aperture offset can be contained in 24 bits. Since there is no actual memory associated with these apertures, the exemplary 16 MB requirement simply represents physical regions of memory space that are reserved.

The aforementioned 14 registers are:

Memory Base Address: 32-bits (32-bits populated; unsigned)—The base address of the physical memory area that is actually accessed. This value is added to the result of the address offset translation to obtain "memory address".

Depth Mask: 32-bits (2-bits populated; unsigned)—The bit mask used to remove the least significant bits of an address before an address translation, and to restore the same bits after the translation. This is done to provide single byte accesses to multi-byte pixel formats. The register will be programmed with a value of 0xFFFFFFFF for 8-bit pixels, 0xFFFFFFFE for 16-bit pixels, and 0xFFFFFFFC for 32-bit pixels.

(Four) Shift: 16-bits (6-bits populated; signed)—The values (shift0, shift1, shift2 and shift3) in these registers specify the right shift for the first step of each of the four portions of the address translation. If the value is negative, the shift is to the left. Bits shifted out of the value are lost. Bits shifted into the value are set to 0.

(Four) Minuend: 32-bits (24-bits populated; unsigned)—YThe values (minuend0, minuend1, minuend2 and minuend3) in these registers are used to invert selected bits in the second step of each of the four portions of the address translation.

(Four) Mask: 32-bits (24-bits populated; unsigned)—The values (mask0, mask1, mask2 and mask3) in these registers are used to mask off selected bits in the third step of each of the four portions of the address translation.

Some embodiments complete the address translations in a single memory access cycle, implementing the translations with combinational logic. The translations in such embodiments can be accomplished through parallelization of the four portions of the memory offset equations so that each translation occurs quickly enough to avoid the addition of any extra cycles to a memory access.

Combinational logic can reduce power efficiency due to unnecessary changes in intermediate states. Some embodiments address power efficiency as follows. First, the address translations are active only when the associated aperture is being accessed. Second, intermediate values within the latter stages of the translation can be eliminated while the early changes are processing. A suitable internal propagation compensation can prohibit changes in later stages until the earlier stages have settled.

FIG. 1 diagrammatically illustrates exemplary embodiments of a data processing apparatus according to the invention. The apparatus of FIG. 1 can be, for example, a palmtop computer, a personal digital assistant, a laptop computer, a notebook computer, or a desktop computer. As illustrated in FIG. 1, both the operating system/user applications and the display controller access the memory 11 directly or through translation logic (15, 19) which implements the address translation operations described in detail above. Aperture logic 13 receives the write access address from the operating system/applications and determines whether the write access address should be translated by the translator 15 or applied directly to the memory 11. Similarly, aperture logic 17 determines whether the read access address provided by the display controller should be translated by translator 19 or applied directly to the memory 11. A user interface 18 permits a user to communicate (e.g., by keyboard, mouse, etc.) with the operating system/user applications, which can run, for example, on a microprocessor, microcontroller or digital signal processor. The display controller drives a display 20 which provides a visual display to the user. A bus 40 supports data transfers to/from the memory 11.

The aperture logic 13 controls a switch 23 to invoke the translator 15 whenever the access address on the bus 33 falls within the aperture implemented by aperture logic 13. Similarly, the aperture logic 17 controls a switch 27 to invoke translator 19 whenever the access address on bus 37 is within the aperture implemented by aperture logic 17.

Figure 1A:
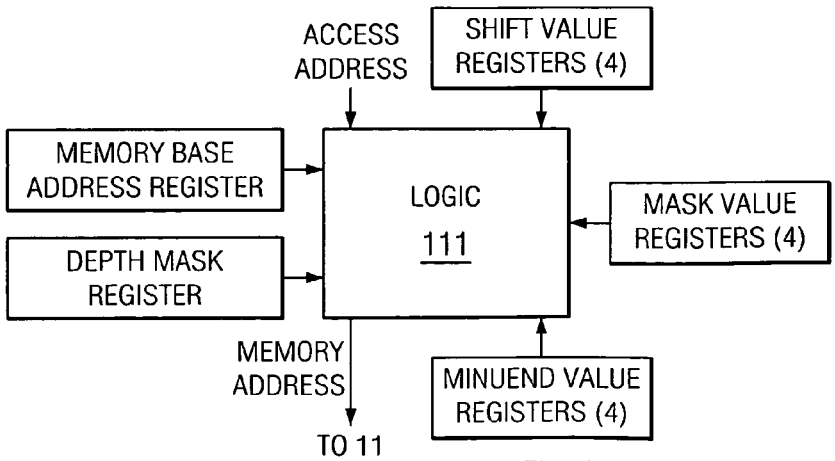
FIG. 1A diagrammatically illustrates exemplary embodiments of the translator logic of FIG. 1.

FIG. 1A diagrammatically illustrates exemplary embodiments of the translator logic (15 or 19) of FIG. 1. As illustrated in FIG. 1A, logic 111, (for example combinational logic) receives inputs from the registers described above, and also receives the access address. The logic 111 combines this input information, for example in the manner described in detail above, to produce the desired memory address for accessing memory 11.

Although exemplary embodiments of the invention are described above in detail, this does not limit the scope of the invention, which can be practiced in a variety of embodiments.

What is claimed is:

1. A data processing apparatus, comprising:

a data processor for performing data processing operations;

a memory coupled to said data processor for storing display information received from said data processor;

a display controller for controlling a visual display, said memory coupled to said display controller for providing said display information to said display controller; and an address translator coupled to said memory and to said data processor and said display controller, said address translator providing a first aperture for receiving write access addresses in a first format, corresponding to a predetermined display orientation, from said data processor and translating said write access addresses into memory write addresses in a second, intermediate, tiled format, for use in storing said display information in said memory in tiles, each tile comprising a page of memory, and a second aperture for receiving read access addresses from said display controller and translating said read access addresses into memory read addresses in a third format for use in reading said display information from said memory for display of an image, the third format being selectable to provide said image in rotated form and in non-rotated form with respect to the predetermined display orientation, while providing said display information by successive accesses from the same page of memory.

2. The apparatus of claim 1, wherein said second memory access format differs from said first memory access format, and wherein said third memory access format differs from said first memory access format.

3. The apparatus of claim 2, wherein said third memory access format differs from said second memory access format.

4. The apparatus of claim 1, including logic coupled between said data processor and said address translator for receiving a plurality of addresses from said data processor and identifying selected ones of said addresses as write access addresses for input to said address translator.

5. The apparatus of claim 4, including logic coupled between said display controller and said address translator for receiving a plurality of addresses from said display controller and identifying selected ones of said addresses as read access addresses for input to said address translator.

6. The apparatus of claim 1, including logic coupled between said display controller and said address translator for receiving a plurality of addresses from said display controller and identifying selected ones of said addresses as read access addresses for input to said address translator.

7. The apparatus of claim 1, wherein the address translator is configured such that the translation provided in the first aperture and the second aperture is performed by translating the access address to a column of a tile, translating the access address to a row of the tile, determining a line within the tile and specifying a byte within the line.

8. The apparatus of claim 1, wherein said memory provides information in bursts having a predetermined size, and wherein said address translator provides said display information in bursts of information, the information in each burst being read by successive accesses from the same page of memory.

9. A data processing apparatus, comprising:

a data processor for performing data processing operations;

a memory coupled to said data processor for storing display information received from said data processor;

a visual display apparatus for providing a visual display to a user;

a display controller coupled to said visual display apparatus and said memory, said memory for providing said display information to said display controller, and said display controller responsive to said display information for controlling said visual display apparatus; and an address translator coupled to said memory and to said data processor and said display controller, said address translator providing a first aperture for receiving write access addresses in a first format, corresponding to a predetermined display orientation, from said data processor and translating said write access addresses into write memory addresses in a second, intermediate, tiled format, for use in storing said display information in said memory in tiles, each tile comprising a page of memory, and a second aperture for receiving read access addresses from said display controller and translating said read access addresses into memory read addresses in a third format for use in reading said display information from said memory for display of an image, the third format being selectable to provide said image in rotated form and in non-rotated form, with respect to the predetermined display orientation, while providing said display information by successive accesses from the same page of memory.

10. The apparatus of claim 9, wherein said address translator is cooperable with said memory for permitting both said data processor and said display controller to operate with respect to said display information in said memory according to a landscape display format, said address translator further cooperable with said memory for causing said display information to be provided to said display controller in a manner that results in said visual display apparatus producing a portrait-oriented image.

11. The apparatus of claim 9, wherein said data processor includes one of a microprocessor, a microcontroller and a digital signal processor.

12. The apparatus of claim 9, provided as one of a palmtop computer, a personal digital assistant, a laptop computer, a notebook computer and a desktop computer.

13. The apparatus of claim 9, wherein said write access addresses and said read access addresses are associated with a first memory access format, wherein said memory write addresses are associated with a second memory access format that differs from said first memory access format, and wherein said memory read addresses are associated with a third memory access format which differs from said first memory access format.

14. The apparatus of claim 13, wherein said third memory access format differs from said second memory access format.

15. A method of producing a visual display, comprising:

storing display information, including receiving write access addresses, translating said write access addresses into write memory addresses, and using said write memory addresses to store said display information;

retrieving said display information, including providing read access addresses, in a first aperture translating said read access addresses into memory read addresses, and in a second aperture using said memory read addresses to retrieve said display information; and using the retrieved display information to produce the visual display, wherein said write access addresses and said read access addresses are associated with a first memory access format, wherein said memory write addresses are associated with a second, intermediate, tiled memory access format that differs from said first memory access format, for use in storing said display information in tiles, each tile comprising a page of memory, and wherein said memory read addresses are associated with a third memory access format which differs from said first memory access format, for use in reading said display information from said memory for display of an image, the third format being selectable to provide said image in rotated form and in non-rotated form, with respect to the predetermined display orientation, while providing said display information by successive accesses from the same page of memory.

16. The method of claim 15, wherein said third memory access format differs from said second memory access format.

17. The method of claim 16, wherein said first memory access format utilizes a plurality of pages of memory locations in a memory, wherein said second memory access format arranges said pages of said first memory access format into respective tiled pages, and wherein said third memory access format arranges said pages of said first memory access format into respective tiled pages.

18. The method of claim 17, wherein said tiled pages of said second memory access format correspond to said tiled pages of said third memory access format, and wherein said tiled pages of said second memory access format are arranged in a tile arrangement that differs from a tile arrangement of said tiled pages of said third memory access format.

* * * * *